United States Patent [19]

Altenschöpfer et al.

[11] Patent Number: 4,801,396

[45] Date of Patent: Jan. 31, 1989

[54] DISHWASHER DETERGENT PASTE

[75] Inventors: Theodor Altenschöpfer, Düsseldorf; Klaus Schumann, Erkrath; Peter Christophliemk, Düsseldorf, all of Fed. Rep. of Germany

[73] Assignee: Henkel Kommanditgesellschaft auf Aktien, Düsseldorf, Fed. Rep. of Germany

[21] Appl. No.: 75,284

[22] Filed: Jul. 20, 1987

Related U.S. Application Data

[63] Continuation of Ser. No. 653,366, Apr. 15, 1986, abandoned, which is a continuation of Ser. No. 357,471, Mar. 12, 1982, abandoned.

[30] Foreign Application Priority Data

Sep. 26, 1981 [DE] Fed. Rep. of Germany ..... 3138425

[51] Int. Cl.[4] ..... C11D 7/14; C11D 7/56

[52] U.S. Cl. ..... 252/99; 134/93; 134/94; 134/100; 134/101; 252/103; 252/140; 252/160; 252/173; 252/174.25; 252/DIG. 14

[58] Field of Search ..... 252/99, 103, 140, 160, 252/173, 174.25, DIG. 14; 134/93, 94, 100, 101

[56] References Cited

U.S. PATENT DOCUMENTS

| | | | |
|---|---|---|---|
| 3,903,909 | 9/1975 | Noren et al. | 134/101 |
| 4,005,027 | 1/1977 | Hartman | 252/99 |
| 4,051,055 | 9/1977 | Trinh et al. | 252/95 |
| 4,051,056 | 9/1977 | Hartman | 252/99 |
| 4,071,377 | 1/1978 | Schwuger et al. | 252/140 |
| 4,115,308 | 9/1978 | Guerry | 252/99 |
| 4,116,849 | 9/1978 | Leikhim | 252/135 |
| 4,116,851 | 9/1978 | Rupe et al. | 252/103 |
| 4,149,655 | 4/1979 | Nelson et al. | 134/93 |

FOREIGN PATENT DOCUMENTS 1237199 6/1971 United Kingdom .

*Primary Examiner*—Robert A. Wax

*Attorney, Agent, or Firm*—Ernest G. Szoke; Henry E. Millson, Jr.; Real J. Grandmaison

[57] ABSTRACT

This invention is directed to an aqueous, thixotropic dishwater detergent composition which is at room temperature a paste having a viscosity of at least about 30 Pa.s as measured at 20° C. with a rotational viscometer at 5 spindle revolutions per minute, the dishwasher detergent composition comprising:

(a) at least one compound with cleaning action or binding capacity for ions causing hardness selected from the group consisting of polyphosphates, aluminosilicates, silicates, hydroxides, and carbonates of sodium or potassium in an amount sufficient to effect cleaning or binding;

(b) an active chlorine compound in an amount sufficient to provide active chlorine to the detergent composition; and (c) a thickener compatible with components (a) and (b) in an amount sufficient to give the desired viscosity.

12 Claims, No Drawings

DISHWASHER DETERGENT PASTE

This application is a continuation of application Ser. No. 853,366, filed Apr. 15, 1986, which is a continuation of Ser. No. 357,471, filed Mar. 12, 1982, now all abandoned.

FIELD OF THE INVENTION

This invention is directed to a detergent paste for use in dishwashers. More specifically, this invention is directed to a detergent paste for dishwashers which comprises a thixotropic paste containing at least one compound with cleaning action, an active chlorine compound, and a thickener.

BACKGROUND OF THE INVENTION

The detergents used in mechanical dishwashers usually are in the form of powders, granulates, or tablets. The feeding devices in these machines, into which the detergents are filled before washing, are constructed to accommodate solid products and normally consist of closable chambers that open during the main wash cycle to release their contents. A number of disadvantages result from this method of operation. When the detergent is poured in, the user must tap the storage package or the measuring cup to make the powder flow into the feed chamber, which frequently leads to the spilling of relatively large quantities of the powder and/or to contact with the skin. These spilled portions usually are lost for the washing operation since they are siphoned off at the end of the pre-wash cycle, together with the cold pre-wash liquor. Also, if powder gets into the opening mechanism of the feed chamber during filling, the cover may not close completely or the magnetic closure or mechanical/electrical closure used in some constructions may not lock securely enough, so that part or all of the powder seeps out when the loading door of the dishwasher is closed and is again lost for the main wash cycle. Problems can also arise in machines in which the feed chamber is additionally secured with a protective screen and detergents are used that do not have an optimal rate of solution or have become lumped together during standing for an extended time in opened cartons. A detergent that is incompletely dissolved during the wash cycle results in poorer cleaning and impairs the action of the acid rinsing agent. Also, conductivity measurements have shown that readily soluble detergents require a relatively long time—under unfavorable circumstances up to 10 minutes—for complete solution following their release, which means that the operation proceeds for a considerable length of time with a low concentration of detergent. Improvements attempted during recent years concerning the machine, the rinsing-in mechanism, and the detergents, have been directed to improvements in the free flow and faster rate of solution for the always solid detergent. The possibility of using liquid agents has been limited to the acid rinsing product, which is usually filled into a storage container.

The use of liquid detergents rather than powders in dishwashers has not been considered since the widely used feeding devices are not suitable for liquid agents as presently constructed. Also, there has been the expectation that a storage tank comprising an integral part of the machine would warm up considerably during each wash cycle and lead to the decomposition of the source of active chlorine normally included in the detergent.

OBJECTS OF THE INVENTION

It is an object of this invention to provide a detergent for dishwashers.

It is also an object of this invention to provide a dishwasher detergent in paste form.

It is a further object of this invention to provide a dishwasher detergent composition which is a paste at room temperature with a viscosity of at least about 30 Pa.s as measured at 20° C. with a rotational viscometer at 5 spindle revolutions per minute and which comprises:

(a) at least one compound with cleaning action or binding capacity for ions causing hardness selected from the group consisting of polyphosphates, aluminosilicates, silicates, hydroxides, and carbonates of sodium or potassium;

(b) an active chlorine compound; and (c) a thickener compatible with components (a) and (b).

These and other objects of the invention will become more apparent in the discussion below.

DETAILED DESCRIPTION OF THE INVENTION

Applicants have found a dishwasher detergent that does not have the above-described disadvantages and can be used in conventional dishwashers. It is envisioned that said detergent could be used in dishwashers to be developed that may have a capability of storing detergent, wherein the detergent would be withdrawn by automatic metering from a storage tank. More particularly, Applicants' invention is directed to an aqueous, thixotropic dishwasher detergent which is a paste at room temperature with a viscosity of at least about 30 Pa.s as measured at 20° C. with a rotational viscometer at 5 spindle revolutions per minute. The dishwasher detergent comprises:

(a) at least one compound with cleaning action or binding capacity for ions causing hardness selected from the group consisting of polyphosphates, aluminosilicates, silicates, hydroxides, and carbonates of sodium or potassium;

(b) an active chlorine compound; and (c) a thickener compatible with components (a) and (b).

The viscosity of the detergent is preferably from about 70 to 200 Pa.s and especially from about 80 to 150 Pa.s, measured as described above.

When the viscosity is determined, care must be taken that the thixotropy of the agent remains essentially undisturbed by the measuring operation. Such disturbances do not occur at a rate of 5 rpm for the spindle inserted into the sample. A Brookfield viscometer, for example, is suitable, but other methods of determination permitting the measuring under comparable conditions can also be employed.

The detergent's rheological behavior is calculated for a level that permits the gel-like paste to be liquefied by the action of mechanical forces, for example, by shaking or pressure applied to a plastic storage bottle or tube or with a metering pump, and to be squeezed out easily through a spray jet or to be transferred into the rinsing-in chamber. As soon as the mechanical action stops, the product again congeals into a gel that remains unchanged, in the rinsing-in chamber, while the flap is closed. This achieves the purpose of keeping the product in its paste form during one or two pre-wash cycles and thus being available only during the cleaning cycle, as intended. As soon as the closing flap has opened and the product comes in contact with the agitated wash liquor, the gel liquefies instantaneously, and the product is quickly distributed in the wash liquor. Consequently, it is available to give the total cleaning power of the detergent from the moment of release into the wash liquor, making the cleaning action more intensive than in the conventional washing process.

The products to be used according to the invention comprise a component (a) with cleaning action, which consists of polyphosphates, aluminosilicates, silicates, hydroxides, or carbonates of sodium or potassium, or their mixtures. Particularly suitable are pentasodium or pentapotassium triphosphate or sodium or potassium silicate with a $Me_2O:SiO_2$ molar ratio of from about 1:0.5 to 1:3.5 (Me=Na,K) as well as mixtures of variously combined silicates, for example, preferably those with a $Me_2O:SiO_2$ molar ratio of from about 1:0.5 to 1:1 with those with a molar ratio of from about 1:2 to 1:3.5.

The tripolyphosphate can be replaced completely or partially by powdered alkali metal aluminosilicates that are insoluble in water, contain bound water, have a calcium-binding capacity of from about 50 to 200 mg CaO/gm of active substance (AS) and correspond to the formula $$0.7\text{–}1.5\ Me_2O \cdot Al_2O_3 \cdot 0.8\text{–}6SiO_2$$

and preferably of the formula $$0.9\text{–}1.3Na_2O \cdot Al_2O_3 \cdot 1.3\text{–}4SiO_2.$$

Such compounds are known, for example, under the name SASIL®, available from Henkel KGaA. The calcium-binding capacity of the aluminosilicates is determined by the following method: One liter of an aqueous solution containing 0.594 gm of CaCl (=300 mg CaO/liter=30°d (German hardness)) and adjusted to pH 10 with dilute NaOH is mixed with 1 gm of aluminosilicate (based upon the active substance). The suspension is then vigorously stirred for 15 minutes at a temperature of 22° C. (±2° C.). After filtering off of the aluminosilicate, the residual hardness x of the filtrate is determined. The calcium-binding capacity is calculated from this in CaO/gm of active substance by the following formula:

$$(30-x) \cdot 10.$$

When the calcium-binding capacity is determined at higher temperatures, for example at 60° C., better values are found in all cases than at 22° C. This circumstance makes the aluminosilicates superior to most of the soluble complexing agents recommended until now for use as phosphate replacements and represents a special technical progress with their utilization.

Also suitable, particularly for commercially operated dishwashers, is sodium hydroxide or potassium hydroxide. Less preferred constituents of the component (a) are also the carbonates or hydrogen carbonates of sodium or potassium, which generally are used only together with alkali metal compounds with a stronger cleaning action.

In a preferred embodiment, component (a) comprises the following:

from about 3 to 40 percent by weight of sodium and/or potassium tripolyphosphate;

from about 5 to 30 percent by weight of sodium and/or potassium silicates;

from 0 to about 25 percent by weight of powdered sodium aluminosilicate that binds calcium salts; and from 0 to about 20 percent by weight of carbonate and/or hydroxide of sodium and/or potassium, based upon the total weight of the detergent composition.

In an especially preferred embodiment, component (a) comprises the following:

from about 5 to 30 percent by weight of sodium and/or potassium tripolyphosphate;

from about 5 to 30 percent by weight of sodium and/or potassium silicate;

from 0 to about 10 percent by weight of sodium aluminosilicate; and from 0 to about 5 percent by weight of sodium and/or potassium hydroxide, based upon the total weight of the detergent composition.

The sodium and/or potassium silicate preferably consists of a mixture of metasilicates having a $Me_2O:SiO_2$ molar ratio of about 1:1 and disilicates or water glass having a $Me_2O:SiO_2$ molar ratio of from about 1:2 to 1:3.5, at a mixing ratio of from about 2:1 to 1:10, especially from about 1:1 to 1:5, calculated, respectively, as anhydrous substance.

Component (b) consists of an active chlorine compound, preferably of sodium, potassium, or lithium hypochlorite. Additional suitable compounds are chlorinated trisodium or tripotassium-o-phosphate. Organic chlorine carriers such as trichloroisocyanuric acid or alkali metal dichloroisocyanurates or N-chlorinated sulfamides or triazines are less preferred since they are less stable in storage in the detergents according to the invention. The amount of chlorine carrier is preferably calculated to result in a content of from about 0.1 to 3.0 percent by weight, especially from about 0.5 to 2.0 percent by weight of active chlorine in the detergents.

Component (c) consists of a thickener that is resistant to alkalies and active chlorine and is capable of forming a thixotropic gel in water. Swelling foliated silicates of the montmorillonite type, which, when made up in a 5 percent by weight suspension have a viscosity of at least 30 Pa.s (20° C.) after complete swelling determined with a conventional rotational viscometer at 5 rpm for the spindle, are useful as thickeners. Complete swelling means that, after substantially homogeneous distribution of the thickener in the water, advantageously performed with the aid of a highly effective agitator at temperatures of from about 30° to 60° C., the viscosity does not increase further after several days of aging or standing at room temperature, even with additional thermal or mechanical treatment.

Natural or synthetic foliated silicates of the hectorite type were found to be particularly suitable for the component (c). The processed natural as well as the synthetic hectorites may still contain certain contaminants, which do not interfere with the use of the products according to the invention. In the case of the processed hectorites, the contaminants comprise other types of foliated silicates or small amounts of admixtures of calcite; in the case of the synthetically prepared compounds, the contaminants comprise, for example, sodium carbonate or sodium sulfate. The water-soluble by-products of the synthesis do not need to be washed thoroughly or even at all, which simplifies the preparation considerably. When synthetic hectorite is used, this does not need to be dehydrated before the preparation of the detergent, but it can be processed further in the form of aqueous suspensions or moist press cakes to produce the detergents to be used according to the invention without additional pre-treatment after separation of most of the water by centrifuging or filtering.

Hectorites generally are trioctadhedral foliated magnesium silicates of the general formula $$[(Li_xMg_{6-x})Si_8O_{20}(OH)_{4-y}F_y]^{x(-)}\cdot(x/n)M^{n(+)}$$

in which x represents a number of from about 0 to 6, y represents a number of from about 0 to 4, n represents an integer of from 1 to 3, and M represents a cation. The cation M preferably represents sodium, and the value for n is then equal to 1. The moisture content of an air-dried product is generally from about 5 to 10 percent by weight.

The synthesis of the hectorites is known, for example, from German Pat. No. 1,184,742 or "Clay and Clay Materials", Vol. 8 (1960), pages 150–169. According to the latter reference, hectorite can be synthesized at atmospheric pressure and reflux temperature with a reaction mixture comprising the system $SiO_2/MgO/Li_2O$(or LIF)$/Na_2O$ in a large excess of water. The starting ratios are based upon the following formula:

$$[(Li_xMg_{6-x})Si_8O_{20}(OH)_4]^{x-}\cdot Na^+.$$

The foliated silicates are used in finely granulated form, that is, the proportion obtained by screening analysis using a screen with 0.25 mm mesh shall be less than 5 percent by weight, preferably less than 1 percent by weight. The amount of foliated silicate to be used depends mainly on its swelling capacity. In the case of hectorite, the addition generally amounts to from about 1 to 10 percent by weight, preferably from about 2 to 6 percent by weight (based upon the hectorite dried at 105° C.) of the aqueous detergent paste.

Nonionic tensides with low foaming capacity, which do not decompose in the presence of active chlorine compounds and, if needed, alkali metal hydroxides, are used as optional constituents. The nonionic tensides are preferably ethylene oxide adducts of higher molecular polypropylene glycols with molecular weights from about 900 to 4,000 as well as adducts of ethylene oxide or ethylene oxide and propylene oxide onto higher fatty alcohols such as dodecyl alcohol, palmityl alcohol, stearyl alcohol, oleyl alcohol, or their mixtures, as well as synthetic alcohols with the chain lengths $C_{12}$–$C_{18}$, for example, those prepared by oxosynthesis, and corresponding alkylene oxide adducts of alkyl phenols, preferably nonyl phenol. Examples of suitable adducts are the adduct of 10 to 30 percent by weight of ethylene oxide onto a polypropylene glycol of the molar weight 1,750, the adduct of 20 mols of ethylene oxide or of 9 mols of ethylene oxide and 10 mols of propylene oxide onto nonyl phenol, the adduct of 5 to 12 mols of ethylene oxide onto a mixture of fatty alcohols with chain lengths of $C_{12}$–$C_{18}$, including a content of approximately 30 percent by weight of oleyl alcohol or similar alcohols. These examples are not intended to limitative. The content of nonionic tensides can amount to up to about 5 percent by weight, preferably from 0.1 to 1 percent by weight, based on the total weight of the detergent.

Chlorine- and alkali-resistant dyes and fragrances can also be added to the dishwashing detergents, if desired.

Other optional constituents comprise accompanying substances in the active substances used, such as sodium sulfate, sodium chloride, or mineral admixtures of the foliated silicate.

Other usable complexing agents generally comprise nitrogen-free complexing agents resistant against active chlorine, for example, polyvalent phosphonic acids such as methylene diphosphonic acid, or polyvalent phosphonocarboxylic acids such as 1,1-diphosphonopropan-1,2-dicarboxylic acid, 1-phosphonopropan-1,2,3-tricarboxylic acid, or 2-phosphonobutan-2,3,4-tricarboxylic acid or their sodium or potassium salts. Additional suitable complexing agents comprise the polycarboxylic acids resistant to active chlorine and their salts.

The detergents to be used according to the invention are advantageously prepared by mixing an aqueous solution or suspension containing the constituents of component (a) that exert a cleaning action, especially the tripolyphosphate and, if desired, the alkali metal silicate (water glass), or a portion of these, together with the thickener, with heating at from about 40° to 65° C., using an agitator that applies strong shear forces, for example, an Ultra-Turrax® machine (available from IKA-Werk, Freiburg, Germany), until thickening occurs. Then, the remaining constituents of component (a), which are in solid or dissolved form, for example, metasilicate, water glass, and, if desired, the remaining triphosphate, as well as the optional constituents such as nonionic tensides and dyes, are stirred in. After cooling to room temperature, the final addition of the active chlorine compound, for example, in the form of a sodium hypochlorite solution (chlorine bleach solution), is made.

The detergents can be filled into the storage containers immediately after their preparation. The maximal viscosity value is generally reached after standing for a period of from two to ten days. A temporary liquefaction is produced by vigorous shaking or pressing, but the gel phase is restored only a few seconds after the mechanical strain is discontinued, that is, the detergent transferred to the holding chamber in the dishwasher congeals with sufficient rapidity that it does not flow out after shutting of the closing flap of the holding chamber or the loading door in the dishwasher.

The detergents to be used according to the invention are characterized by a strong cleaning action and especially by a high storage stability. The loss of active chlorine during a standing time of six months at 25° C. has been found to be approximately the same as that of the commercial detergent granulates stored dry. Also, a surprising observation was that temperatures of about 60° C. were not detrimental to the storage stability or the content of active chlorine. This became apparent during an experiment in which a holding chamber adequate for ten wash cycles, together with a connected metering pump, was built into the loading door of a conventional dishwasher, and the metering of the detergent was controlled by programming. During the experimental period of five days (2 wash cycles per day), the detergent paste, which was warmed up repeatedly due to heat transfer, did not sustain a loss of active chlorine significant enough to impair the cleaning result.

The observation of the rinsing-in behavior by conductivity measurements showed that the detergent was completely rinsed down within 1 to 4 minutes after opening the holding chamber and was completely dissolved or suspended within 2 to 5 minutes. This operation usually takes 7 to 15 minutes, in unfavorable cases up to 20 minutes, with powdered or granulated detergents.

A special advantage, furthermore, is the fact that the substances can be metered with considerably greater ease and accuracy than regular granular or powdered detergents, which often are partially spilled during filling into the relatively small holding chambers due to the usually necessary shaking of the storage container or measuring cup. The danger of impairing the functioning of the opening mechanism due to spilled detergent and that, especially in chambers with magnetic closure, the contact is not sufficiently tight so that the flap opens too soon, is eliminated with the use of the products according to the invention.

Bleaching pastes containing two different types of clay, among them hectorite, as thickeners as well as active chlorine compounds were known from British Pat. No. 1,237,199, where the products are applied for use to the goods to be bleached and remain on the place of contact for some time due to their gel structure and thus have a particularly sustained action. However, it could not be discerned from this patent that products such as those described herein would be suitable as detergents in dishwashers. Furthermore, scouring pastes containing anionic, nonionic, zwitterionic, or ampholytic tensides, that is, mainly those with active foam, as well as bleaches with active chlorine, clay-like builders, including hectorite, and, as main constituent, a special abrasive component, are described in U.S. Pat. Nos. 4,051,055 and 4,051,056 as well as in German published applications (DE-OS) Nos. 25 39 733 and 27 39 776. The thickener is used mainly to prevent the settling of the abrasive, which has a low specific weight. The idea of using low-foaming detergents that are free of abrasives instead of conventional powdered or granulated products in dishwashers is completely foreign to these publications, particularly since the purpose is entirely different.

The following examples are intended to illustrate the invention and should not be construed as limiting the invention thereto.

EXAMPLES

Two different foliated silicates of the hectorite type containing lithium and fluorine were used as thickeners. The product referred to as "Hectorite I" below is a commercial product, available from Lanco; the product referred to as "Hectorite II" is the commercial product Laponite B®, available from Laporte Ind. Ltd. The moisture content of the products (drying loss at 105° C.) was approximately 7 to 8 percent by weight, and the particle or granular size (screening analysis) was less than 0.2 mm with a mean granular size of approximately 0.006 to 0.008 mm. The viscosity of a 5 percent by weight aqueous gel, determined with a rotational Brookfield viscometer at 5 rpm for the spindle (20° C.), was 75 Pa.s for Hectorite I and 95 Pa.s for Hectorite II.

The cleaning capacity of the detergent pastes given in the examples below was tested in the so-called normal program (normal cycle) of a regular household dishwasher (Miele G 503®).

To test the cleaning results, glass dishes with food residue of milk, chocolate pudding, and ground meat, dinner plates with dried-on residue of oatmeal and starch, as well as cups with dried-on tea residue, treated under defined conditions at 300° C. (according to the publication "Testing of Detergents and Rinsing Agents for Automatic Dishwashing" in Seifen-Ole-Fette-Wachse 98: 763–766, 801–806, 1972), were washed in the usual manner, but without a rinse with an acid rinsing agent, in the household dishwasher with 3 gm of detergent per liter of wash liquor (based upon the cleaning substance contained in the detergent). The soil substances were selected to make removal even with other conventional detergents that have a strong cleaning power only partially possible so that a differentiation is still possible even with these high-powered products. The evaluation was made with a point system ranging from 0 to 10, 0 points representing "without recognizable cleaning action" and 10 points representing "complete removal of the test soil."

A commercial, granulated detergent used for comparison had the following composition:

| Component | Percent by Weight |
|---|---|
| Sodium tripolyphosphate | 36 |
| Sodium metasilicate | 40 |
| Sodiun carbonate | 5.5 |
| Sodium dichloroisocyanurate | 2 |
| Nonionic tenside | 0.5 |
| Water | 16 |
| | 100.0 |

Storage tests for the determination of the losses of active chlorine were performed for six months at approximately 25° C. and 80% relative humidity. The pastes and the granulated comparison samples were stored in brown glass bottles.

Detergent compositions prepared according to the invention are set forth in the following examples:

EXAMPLE 1

A paste composition comprising:

| Component | Percent by Weight |
|---|---|
| Pentapotassium triphosphate | 27 |
| Hectorite II | 4 |
| Sodium metasilicate ($Sio_2$:$Na_2O$ = 1:1) | 10 |
| Sodium disilicate ($SiO_2$:$Na_2O$ = 1:2) | 12 |
| NaOCl (corresponding to 1.2% active chlorine) | 1.3 |
| NaCl | 1.2 |
| Water | balance |

was prepared by agitation of the 50% triphosphate solution, which was heated to 55° C., together with the hectorite with a high-speed agitator (Ultra-Turrax®) until thickening occurred. Then, 2 percent by weight of sodium metasilicate in the form of a dust-like powder was added with agitation. After the addition of the disilicate in the form of a 54.5 percent by weight solution, the paste was cooled, and the sodium hypochlorite in the form of a chlorine bleach solution containing NaCl (active chlorine content of 13%) as well as rest of the sodium metasilicate were added.

The viscosity, measured after a standing time of ten days under the above-described conditions, was 125 Pa.s.

EXAMPLE 2

Example 1 was repeated, with the exception that dry potassium tripolyphosphate was stirred into an aqueous slurry prepared from Hectorite I, which was moist from filtering and allowed to swell, the total amount of water remaining unchanged. Further processing was the same as described in Example 1. The viscosity of the paste, determined under the above-described conditions, was 115 Pa.s.

EXAMPLE 3

As described above, a detergent composition comprised of:

| Component | Percent by Weight |
|---|---|
| Pentapotassium triphosphate (used as 50% aqueous solution) | 27.5 |
| Hectorite II | 3 |
| Sodium metasilicate (1:1) | 4 |
| Water glass ($SiO_2$:$Na_2O$ = 1:3.3) | 8 |
| Sodium disilicate ($SiO_2$:$Na_2O$ = 1:2) | 10.9 |
| NaOCl (corresponding to 1.2% active chlorine) | 1.3 |
| NaCl | 1.2 |
| Water | balance |

was prepared by working into a paste, with agitation, a 50% triphosphate solution mixed with the hectorite, with addition of finely powdered metasilicate and finely powdered sodium disilicate, cooling, and incorporation of the chlorine bleach solution (active chlorine content of 13%). The paste had a viscosity of 105 Pa.s after standing for ten days at room temperature.

EXAMPLE 4

Example 3 was repeated with the exception that Hectorite I was used as the thickener rather than Hectorite II. The viscosity of the product was 103 Pa.s.

EXAMPLE 5

A detergent composition comprised of:

| Component | Percent by Weight |
|---|---|
| Pentapotassium triphosphate (50% solution) | 21 |
| Hectorite II (powder) | 5 |
| Sodium hydroxide (50%) | 3 |
| Sodium disilicate (54.5% solution) | 10.9 |
| Sodium metasilicate (powder) | 10.9 |
| Sodium triphosphate (powder) | 3 |
| NaOCl | 1.6 |
| NaCl | 1.6 |
| Water | balance |

was prepared by mixing the components, in the order presented, at 55° C., with a high-speed agitator. Chlorine bleach solution was incorporated after cooling of the paste. The viscosity of the paste, determined as described above after ten days of standing, was 98 Pa.s.

EXAMPLE 6

A detergent composition comprised of:

| Component | Percent by Weight |
|---|---|
| Pentapotassium triphosphate (50% solution) | 25 |
| Sodium aluminosilicate (powder) (zeolite A, particle size 1–10 micron, calcium-binding capacity 170 mg (CaO/g at 20° C.)) | 5 |
| Hectorite II (powder) | 3 |
| Sodium metasilicate | 4 |
| Water glass ($SiO_2$:$Na_2O$ = 1:3.3, powder) | 6 |
| Sodium disilicate (54.5% solution) | 12 |
| NaOCl | 1.3 |
| NaCl | 1.2 |
| Water | balance |

was prepared by mixing the above components in the indicated order. Chlorine bleach solution was added after cooling of the mixture, which was heated to 60° C. The viscosity was measured to be 120 Pa.s after ten days of standing.

EXAMPLE 7

Example 6 was repeated but with the addition of 0.3 percent by weight of a nonionic, non-foaming tenside from the group consisting of the polypropylene oxide/-polyethylene oxide block polymers, prior to the addition of the chlorine bleach solution. The viscosity of the paste was 118 Pa.s after standing for ten days.

The commercial detergent and the detergents according to the invention were tested for cleaning power and chlorine retention, the dose of each detergent according to the invention being 4.5 gm of paste per liter of wash liquor and the dose of the commercial detergent being 3.0 gm of powder per liter of wash liquor. The test results are set forth in the following table:

TABLE

| | Cleaning Power | | | | | | | |
|---|---|---|---|---|---|---|---|---|
| Example | Milk | Tea | Fatty Substance | Meat | Pudding | Oatmeal | Starch | Loss of Active Chlorine (%) |
| 1 | 8.2 | 10.0 | 9.5 | 5.8 | 7.6 | 5.4 | 5.5 | 35 |
| 2 | 8.2 | 10.0 | 9.5 | 5.8 | 7.6 | 5.4 | 5.5 | 36 |
| 3 | 8.1 | 10.0 | 9.0 | 8.0 | 8.5 | 5.4 | 5.8 | 36 |
| 4 | 8.1 | 10.0 | 9.1 | 8.0 | 8.5 | 5.4 | 5.8 | 38 |
| 5 | 8.6 | 10.0 | 10.0 | 6.0 | 8.5 | 5.4 | 6.5 | 22 |
| 6 | 8.0 | 10.0 | 9.5 | 7.8 | 7.6 | 6.0 | 5.5 | 28 |
| 7 | 8.1 | 10.0 | 9.5 | 7.9 | 7.6 | 5.9 | 5.6 | 30 |
| Comparison | 8.0 | 10.0 | 9.2 | 6.0 | 5.2 | 5.2 | 5.3 | 32 |

The test results set forth above indicate that the paste detergent compositions prepared according to the invention were as effective as, and in some instances more effective than, the known, comparison granulated detergent. The retention of chlorine was also on the same order of magnitude.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In a process for washing dishes in an automatic dishwashing machine comprising subjecting dirty dishes and utensils to the action of a wash forcefully projecting an aqueous solution containing a detergent composition on the surface of said dirty dishes and utensils, said detergent composition being released into said wash only, the improvement comprising employing as said detergent composition an aqueous, thixotropic dishwasher detergent composition which at room temperature is a paste having a viscosity of at least about 30

Pa.s. as measured at 20° C. with a rotational viscometer at 5 spindle revolutions per minute, is completely dissolved or suspended within about 2 to about 5 minutes after being released into said wash, and which consists essentially of:

(a) from about 3 to 40 percent by weight of sodium or potassium tripolyphosphate; from about 5 to 30 percent by weight of sodium or potassium silicate containing a mixture of metasilicate having a $Me_2O:SiO_2$ molar ratio of about 1:1 and disilicate or waterglass having a $Me_2O:SiO_2$ molar ratio of from about 1:2 to 1:3.5 in a weight ratio of from about 1:1 to 1:5 wherein Me is sodium or potassium; from 0 to about 25 percent by weight of powdered, sodium aluminosilicate that binds calcium salts; and from 0 to about 20 percent by weight of sodium or potassium carbonate or hydroxide;

(b) an alkali metal hypchlorite in an amount sufficient to provide an active chlorine content of the composition of from about 0.1 to 3.0 percent by weight; and (c) from about 1 to 10 percent by weight of a swellable silicate that is resistant to alkalies and active chlorine and is capable of forming a thixotropic gel in water, said silicate consisting essentially of a hectorite selected from a trioctadhedral foliated magnesium silicate having the general formula $$[(Li_xMg_{6-x})Si_8O_{20}(OH)_{4-y}F_y]^{x(-)}.(x/n)M^{n(+)}$$

wherein x represents a number of from 0 to about 6, y represents a number of from 0 to about 4, n represents an integer of from 1 to 3, and M represents a cation, all weights being based on the total weight of the detergent composition.

2. In a process as in claim 1 wherein the viscosity of said detergent composition is from about 70 to about 200 Pa.s.

3. In a process as in claim 1 wherein the viscosity of said detergent composition is from about 80 to about 150 Pa.s.

4. In a process as in claim 1 wherein said composition contains; from about 5 to about 30 percent by weight of said sodium or potassium tripolyphosphate, from about 5 to about 30 percent by weight of said sodium or potassium silicate, from 0 to about 10 percent by weight of said sodium aluminosilicate, and from about 0 to about 5 percent by weight of said sodium or potassium hydroxide.

5. In a process as in claim 1 wherein said alkali metal hypochlorite is selected from sodium hypochlorite, potassium hypochlorite, or lithium hypochlorite.

6. In a process as in claim 1 wherein said weight ratio of metasilicate and disilicate is from about 1:1 to 1:15.

7. In a process for washing dishes in an automatic dishwashing machine comprising subjecting dirty dishes and utensils to the action of a wash forcefully projecting an aqueous solution containing a detergent composition on the surface of said dirty dishes and utensils, said detergent composition being released into said wash only, said detergent composition consisting essentially of:

(a) from about 3 to 40 percent by weight of sodium or potassium tripolyphosphate; and (b) an alkali metal hypochlorite in an amount sufficient to provide an active chlorine content of the composition of from about 0.1 to 3.0 percent by weight; the improvement comprising employing as said detergent composition an aqueous, thixotropic dishwasher detergent composition which at room temperature is a paste having a viscosity of at least about 30 Pa.s as measured at 20° C. with a rotational viscometer at 5 spindle revolutions per minute, is completely dissolved or suspended within about 2 to about 5 minutes after being released into said wash, and which contains;

(c) from about 5 to about 30 percent by weight of sodium or potassium silicate containing a mixture of metasilicate having a $Me_2O:SiO_2$ molar ratio of about 1:1 and disilicate or waterglass having a $Me_2O:SiO_2$ molar ratio of from about 1:2 to 1:3.5 in a weight ratio of from about 1:1 to 1:5 wherein Me is sodium or potassium;

(d) from 0 to about 25 percent by weight of powdered, sodium aluminosilicate that binds calcium salts;

(e) from 0 to about 20 percent by weight of sodium or potassium carbonate or hydroxide; and (f) from about 1 to about 10 percent by weight of a swellable silicate that is resistant to alkalies and active chlorine and is capable of forming a thixotropic gel in water, said silicate consisting essentially of a hectorite selected from a trioctadhedral foliated magnesium silicate having the general formula $$[(Li_xMg_{6-x})Si_8O_{20}(OH)_{4-y}F_y]^{x(-)}.(x/n)M^{n(+)}$$

wherein x represents a number of from 0 to about 6, y represents a number of from 0 to about 4, n represents an integer of from 1 to 3, and M represents a cation, all weights being based on the total weight of the detergent composition.

8. In a process as in claim 7 wherein the viscosity of said detergent composition is from about 70 to about 200 Pa.s.

9. In a process as in claim 7 wherein the viscosity of said detergent composition is from about 80 to about 150 Pa.s.

10. In a process as in claim 7 wherein said composition contains;

from about 5 to about 30 percent by weight of said sodium or potassium tripolyphosphate, from about 5 to about 30 percent by weight of said sodium or potassium silicate, from 0 to about 10 percent by weight of said sodium aluminosilicate, and from 0 to about 5 percent by weight of said sodium or potassium hydroxide.

11. In a process as in claim 7 wherein said alkali metal hypochlorite is selected from sodium hypochlorite, potassium hypochlorite, or lithium hypochlorite.

12. In a process as in claim 7 wherein said weight ratio of metasilicate and disilicate is from about 1:1 to 1:15.

* * * * *